US005534136A

United States Patent [19]

Rosenbloom

[11] Patent Number: 5,534,136

[45] Date of Patent: Jul. 9, 1996

[54] METHOD AND APPARATUS FOR THE SOLVENT EXTRACTION OF OIL FROM BITUMEN CONTAINING TAR SAND

[76] Inventor: William J. Rosenbloom, 8 Pioneer Rd., Westport, Conn. 06880

[21] Appl. No.: 366,261

[22] Filed: Dec. 29, 1994

[51] Int. Cl.[6] ..... C10G 1/04

[52] U.S. Cl. ..... 208/390; 208/391; 196/14.52

[58] Field of Search ..... 208/390, 391; 196/14.52

[56] References Cited

U.S. PATENT DOCUMENTS

| | | | |
|---|---|---|---|
| 3,875,046 | 4/1975 | Rosenbloom | 208/11 |
| 4,046,668 | 9/1977 | Farcasiu et al. | 208/11 |
| 4,054,505 | 10/1977 | Hart, Jr. et al. | 208/11 |
| 4,071,433 | 1/1978 | Hanson | 208/11 |
| 4,108,760 | 8/1978 | Williams et al. | 208/11 |
| 4,139,450 | 2/1979 | Hanson et al. | 208/11 |
| 4,341,619 | 7/1982 | Poska | 208/11 |
| 4,347,118 | 8/1982 | Funk et al. | 208/11 |
| 4,416,764 | 11/1983 | Gikis et al. | 208/11 |
| 4,498,971 | 2/1985 | Angelov et al. | 208/11 |
| 4,532,024 | 7/1985 | Haschke et al. | 208/11 |
| 4,596,651 | 6/1986 | Wolff et al. | 208/390 |
| 5,143,598 | 9/1992 | Graham et al. | 208/390 |

*Primary Examiner*—Asok Pal

*Assistant Examiner*—Bekir L. Yildirim

*Attorney, Agent, or Firm*—Ware, Fressola, Van Der Sluys & Adolphson

[57] ABSTRACT

A method and apparatus for extracting bitumen whereby tar sand containing bitumen components is contacted with a heated thinning oil mixture to reduce the tar sand viscosity and dissolve bitumen to form a lower viscosity feed slurry. The feed slurry is contacted with a light oil in a separator wherein the mixture is separated into product oil and oil sand. The oil sand is washed with solvent in a countercurrent fashion to extract occluded oil to form the light oil. Washed sand containing solvent is heated above the boiling point of the solvent in a multi-hearth solvent recovery furnace to vaporize the solvent. The solvent vapors are stripped from the sand by flowing inert gas through the sand in the multi-hearth solvent recovery furnace. Inert gas containing solvent vapors is directed from the multi-hearth solvent recovery furnace to a heat exchanger/scrubber where the inert gas and solvent vapors are contacted with product oil from the separator. The solvent vapors are absorbed by the product oil to form the heated thinning oil mixture which is contacted with the tar sand. The resulting thinning oil temperature is greater than the product oil due to heat transfer from the solvent vapors and inert gas. Inert gas is recycled from the heat exchanger/scrubber back to the multi-hearth solvent recovery furnace.

8 Claims, 2 Drawing Sheets

METHOD AND APPARATUS FOR THE SOLVENT EXTRACTION OF OIL FROM BITUMEN CONTAINING TAR SAND

BACKGROUND OF THE INVENTION

1. Field of the Invention

The present invention generally relates to the recovery of bitumen from tar sands. More particularly, the present invention relates to a method and apparatus for efficient solvent extraction of bitumen from viscous tar sands.

Tar sands, also known as bituminous sands and oil sands, are primarily aggregates of sand, clay, oil and, sometimes, water. Tar sands are capable of being surface mined. There are large known reserves of heavy petroleum locked up in tar sand deposit in various parts of the world, including the United States.

One of the best known tar sand deposits is the Athabasca tar sands in Alberta, Canada. It has been estimated that Athabasca contains recoverable reserves in excess of 250 billion barrels of oil. This quantity is significant because the proven world wide oil reserves is on the order of 850 billion barrels. At the present rate of consumption, there is less than 40 year supply of oil. Therefore, there is a need for a process capable of producing oil from tar sand in sufficiently large quantifies in an economical and environmentally acceptable manner.

The Athabasca tar sands contain 5 to 20 percent heavy oil by weight. This constitutes approximately one barrel of oil per 2 tons of sand. The Athabasca tar sands also contain fine particles of clay and silt which can range from 1 to 50 percent by weight, and between 1 and 10 percent water, depending upon the amount of clay present in the tar sand. The average water content is approximately 6 percent.

As mentioned above, tar sand deposits are also known to exist in the United States. One of the largest U.S. deposits is the Sunnyside deposit in Utah. As compared to Athabasca, Sunnyside is relatively small, containing reserves estimated at 1 to 2 billion barrels of bitumen. Generally, the U.S. deposits of tar sand differ from the Athabasca deposit in that the U.S. tar sands do not have a coating of water along with the coating of bitumen. Consequently, the hot water process used for the Athabasca tar sands cannot be used for U.S. deposits.

2. Description of the Prior Art

There are scores of patents that disclose diverse processes and apparatus for recovering oil from tar sands. For example, U.S. Pat. No. 4,046,668, entitled "Double Solvent Extraction of Organic Constituents from Tar Sands," discloses a method wherein the extraction of hydrocarbons from tar sands is performed with a light naphtha/methanol solvent system. The patent specification claims that the system results in rapid precipitation of a tar-sand aggregate and separation of the organic matter into three phases. Non-polar organic materials are recovered from the light naphtha phase, more polar soluble constituents are recovered from the methanol phase and less desirable asphaltene constituents are separated as a precipitate. The drawback with this process is that it requires the use of two solvents which tends to increase the costs of processing a unit of tar sand.

In another example, U.S. Pat. No. 4,347, 118, entitled "Solvent Extraction Process for Tar Sands," discloses a solvent extraction process wherein a low boiling solvent having a normal boiling point from 20° to 70° C. is used to extract tar sands. Initially, the solvent is mixed with tar sands in a ratio of approximately 0.5:1 to 2:1 in a dissolution zone. The mixture is passed to a separation zone in which bitumen and inorganic fines are separated from extracted sand. The separation zone comprises a classifier and a countercurrent extraction column. The extracted sand is introduced into a first fluid-bed drying zone fluidized by heated solvent vapors, where unbound solvent is extracted from sand and the water content of the sand is lowered to less than approximately 2 weight percent. The so-treated sand is passed into a second fluid-bed drying zone fluidized by a heated inert gas to remove bound solvent. Recovered solvent is recycled to the dissolution zone. The major drawback of this process is that the drying process using fluidized beds is not energy efficient. Also, according to the patent, good fluidization requires lowering the moisture content of the extracted sand to less than 2 weight percent.

Finally, in yet another example, U.S. Pat. No. 5,143,598 entitled "Methods of Tar Sand Bitumen Recovery," discloses a method comprising the steps of mixing tax sand, solvent and a displacing amount of aqueous medium to form a mixture. A bitumen-rich solvent phase is separated from the mixture and the bitumen therein is recovered. The mixture is separated into a bitumen-rich solvent phase. The primary drawback with this process is that the solvent recovery process using steam vaporization and-condensation is energy inefficient.

One of the best known and commercially successful prior art processes is the "hot water method." In the "hot water method," tar sand is treated with steam and thoroughly mulled and aerated in a large rotating drum with hot water. The resulting pulp is dropped into a turbulent stream of circulating hot water and carried to a separation cell wherein the sand settles to the bottom and the oil rises to the top in the form of a frothy mixture of minerals and oil. The frothy mixture is mixed with naphtha and fed to centrifuges to separate water and clay. The "hot water method" has several serious disadvantages. First, the separation of oil from the sand is difficult, and even with a great number of separation stages, complete recovery of the oil cannot be obtained. Second, large quantifies of process water, on the order of 150 to 250 gallons per ton of tar sand processed is required. For example, the production of 200,000 barrels of oil per day requires approximately 60 to 100 million gallons of process water per day. This large quantity of process water represents large heat losses and disposal problems. Furthermore, oil cannot be recovered in sufficient quantities needed to satisfy the demand due to the limited availability of water at the tar sand site. While some of the water from the "hot water processes" may be recycled back into the process after treatment in settling ponds, the quantity recycled is limited by the large areas of land needed for the settling ponds because the process water typically contains suspended fines.

There are various other prior art methods proposed in patents that utilize a hydrocarbon solvent to extract oil from the tar sands. These methods appear attractive because separating the bitumen from the sand is relatively easy. However, a major problem with such processes is the difficulty with recovering the solvent contained in large volumes of sand. Also, these prior art processes require large amounts of solvent to form a slurry with the tar sand feed and the energy requirement for recovering solvent can be high. Furthermore, the solvent capable of dissolving all components of the bitumen (generally oil, resin, and asphaltenes), must also be compatible with the refinery operations.

SUMMARY OF THE INVENTION

The present invention is designed to overcome the limitations that are attendant upon the use of the prior art processes to provide an efficient and environmentally acceptable process for the solvent extraction of bitumen products from tar sands. According to the present invention tar sand, which is a very viscous substance containing sand, clay, bitumen (oil, resins, and asphaltenes), and water, is combined with heated thinning oil to rapidly digest the bitumen and form a feed slurry having a lower viscosity as compared with the original tar sand viscosity. The heated thinning oil is obtained by contacting product oil with hot solvent vapors wherein the hot solvent vapors are absorbed by the product oil. The feed slurry and a light oil (solvent containing recovered occluded oil) are fed to a separating vessel wherein the resulting mixture is separated into product oil (which contains fines) that rises towards the top of the separator, and oil sand, (water wet sand having occluded oil) falling towards the bottom of the separator. A portion of the product oil is fed to a heat exchanger/scrubber where it is transformed into the heated thinning oil by absorption of solvent vapors, and the remainder of the product oil is withdrawn as a product stream from the separator for further refinery processing.

The oil sand is countercurrently washed with solvent to recover the occluded oil. In a preferred embodiment, the countercurrent washing step is conducted in a screw conveyor wherein the oil sand is conveyed upwardly against a downwardly flowing solvent stream. The screw conveyor provides some agitation of the oil sand. The countercurrent washing of oil sand forms the light oil which is introduced to the separator, and washed sand (sand wet with solvent and water and substantially free of occluded oil). The washed sand is introduced to a solvent recovery furnace where it is heated to a temperature above the boiling point of the solvent to vaporize the solvent. The vaporized solvent is stripped from the sand by inert gas (such as nitrogen or carbon dioxide) which carries it and water vapor to the heat exchanger/scrubber. The solvent vapor introduced into the heat exchanger/scrubber is contacted with the product oil therein, wherein the solvent vapor is absorbed by the product oil to from the heated thinning oil. Water vapor, also introduced into the heat exchanger/scrubber is condensed and removed.

It is an object of the present invention to provide a method and apparatus for extracting oil from tar sand.

It is another object of the present invention to provide a energy and material efficient apparatus and method for extracting oil from tax sand.

Other objects and advantages of the present invention will become apparent to those skilled in the art from the following detailed description read in conjunction with the attached drawings and claims appended hereto.

BRIEF DESCRIPTION OF THE DRAWINGS

The drawings, not drawn to scale, include.

DETAILED DESCRIPTION OF THE PRESENT INVENTION

Figure 1:
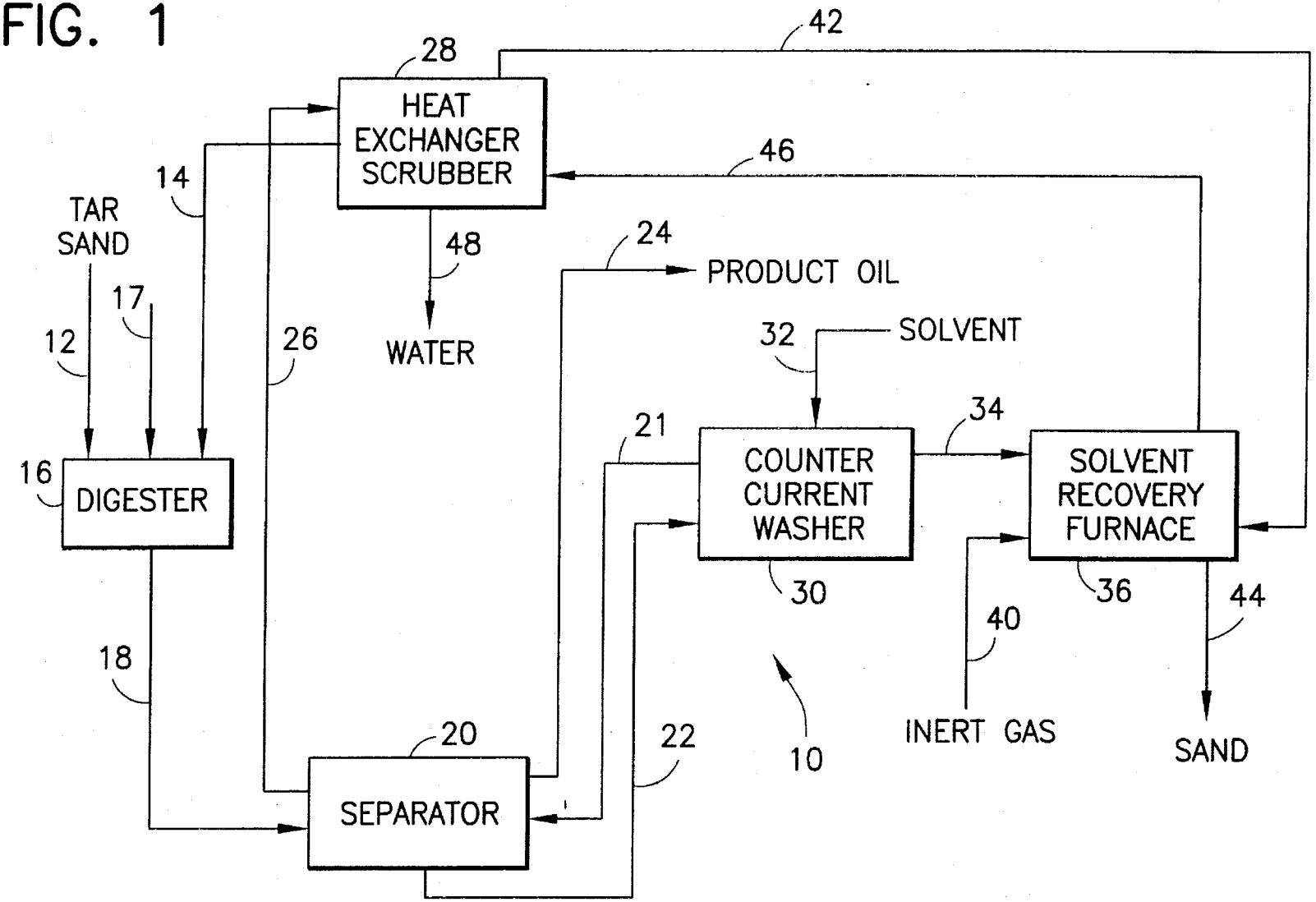
FIG. 1, which is a simplified schematic diagram of a method for extracting oil from tar sand according to the method of the present invention.
Figure 2:
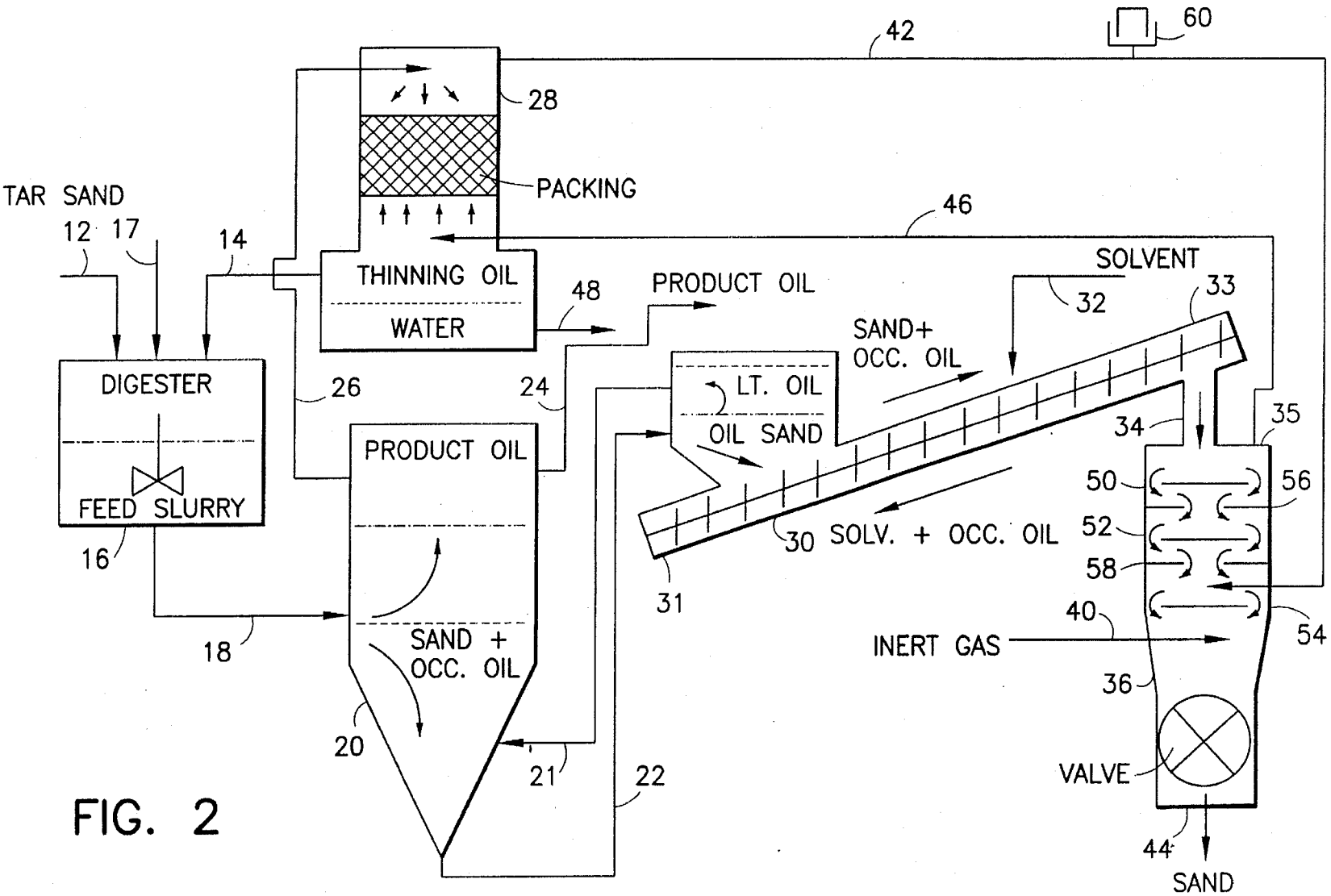
FIG. 2, which is a schematic diagram of one embodiment of apparatus to carry out the method of the present invention.

The method 10 for solvent extraction of bitumen from tar sand is generally illustrated by the schematic diagrams of FIGS. 1 and 2. It is to be understood that the method 10 employs several recycle streams to make the extraction process more energy efficient and to aid with material handling. For the purposes of simplification, the following discussion of the present invention is divided into several parts.

Tar Sand Viscosity Thinning and Bitumen Digestion

Viscous tar sand comprising sand, clay, water, and bitumen (oil, resin, and asphaltene), is introduced to a digester 16 via line 12. Hot thinning oil (product oil having absorbed hot solvent vapor), heated (described more fully below) to a temperature suitable for rapid and complete digestion of the bitumen (a temperature as high as possible without undue vapor emission), is also introduced to the digester 16 via line 14. The digester 16 may have one or more agitators to ensure rapid and complete digestion of bitumen from the tar sand. Rapid digestion of bitumen by the hot thinning oil results in a feed slurry generally comprising bitumen dissolved in the hot thinning oil and sand having occluded oil (oil still attached to the sand). The hot thinning oil ensures that the feed slurry has a substantially reduced viscosity as compared with the viscosity of the bitumen in the tar sand. The desired viscosity is obtained by controlling the volume of hot thinning oil introduced in the digester. The ratio of solvent in the hot thinning oil, as introduced via line 14, to the bitumen of the tar sand in the digester 16 should be maintained, preferably, in the range of about 0.5:1 to 1:1 by volume to dissolve the bitumen and sufficiently thin the viscosity of the feed slurry. It should be appreciated by those skilled in the an that it is desirable to keep the ratio of solvent to bitumen contained in the tar sand as low as possible to ensure minimal energy requirements. The advantage of using hot thinning oil to form a slurry in the digester 16 is that a lower solvent to bitumen ratio is possible as compared to prior an processes.

Separation of Product Oil from Sand in Feed Slurry

The feed slurry is conveyed from the digester 16 to a separator 20 via line 18. Light oil (solvent containing recovered occluded oil) is transported from a countercurrent washer 30, via line 21, to the separator 20 where it is introduced at a point below a point where the feed slurry is introduced. The light oil is allowed to flow upwardly against downwardly flowing sand from the feed slurry. This relative flow in the separator 20 serves as a mechanism for extracting some of the occluded oil from the sand in the feed slurry. The remaining occluded oil (not extracted in the separator) is recovered in the countercurrent washer 30, as will be described more fully below.

The feed slurry and light oil mixture are separated by gravity into product oil (which contains fines) that rises towards the top of the separator 20 and oil sand, comprising water wet sand having occluded oil thereon, settling to the bottom of the separator 20. A portion of the product oil at the top of the separator 20 is with drawn as a product stream and is sent to a refinery via line 24. The product stream may be sent to the refinery via a settling tank (not shown) or a centerfuge (not shown) to settle out or otherwise remove the fines contained therein before going on to refining processes in a refinery. It should be appreciated by those skilled in the art that solvent contained in the product oil may be recovered in the refinery and reused in the process, as will be further described below. A portion of the product oil is conveyed from the separator 20 to a heat exchanger/scrubber 28 via line 26. The product oil conveyed to the heat exchanger/scrubber is transformed into the heated thinning oil introduced to the digester 16 by direct contact with hot solvent, water vapors and inert gas. The process steps and apparatus for forming the hot thinning oil from product oil and solvent vapors will be explained more fully below in the section describing solvent and heat recovery.

Recovery of Occluded Oil from Oil Sand

According to the present invention, the oil sand is transported along line 22 from the separator 20 to the countercurrent washer 30 where it is contacted in countercurrent fashion with solvent (from a refinery) to recover occluded oil from the oil sand and form light oil. The quantity of solvent introduced to the countercurrent washer 30 via line 32 is the amount required to extract the occluded oil from the oil sand. Any additional solvent needed in the process for the extraction of bitumen from the tar sand can be fed directly to the digester 16 via line 17.

The countercurrent washer 30 is configured such that the light oil is conveyed from the countercurrent washer 30 to the separator 20, via line 21, where it is further used to recover occluded oil from the oil sand, as described above. Washed sand (sand substantially free of occluded oil, but wet with solvent and water) is transferred from the countercurrent washer 30 to a solvent recovery furnace 36, wherein substantially all of the solvent is stripped from the sand, as described below.

Paraffinic hydrocarbons including pentane, hexanes, octanes, and naphtha may be used as solvents in the countercurrent washer 30 to extract occluded oil from the oil sand. Although naphtha is the preferred solvent because it is compatible with refinery operations and has been found to be more effective in dissolving bitumen, especially the asphaltene component thereof, any solvent capable of dissolving bitumen and compatible with refinery operations may be used. Solvent compatibility with refinery operations is important because variations in the amounts of solvent in the product oil will not unduly upset the refinery process to which the product oil is generally sent.

As illustrated in more detail in FIG. 2, the countercurrent washer 30 may be a sloping screw type conveyor having a first end 31 and a second end 33 wherein the solvent is introduced via line 32 at an elevated point on the conveyor near the second end 33. As those skilled in the art will appreciate, the slope of the conveyor will depend on the properties of the oil sand being processed. While it is typically desirable to have the conveyor slope as close to horizontal as possible, as this provides maximum propulsion efficiency, some slope is useful in that it promotes churning of the oil sand for good mixing with solvent, as well promoting countercurrent flow of solvent relative to the conveyed oil sand. As the slope of the screw conveyor is increased, propulsion efficiency of the conveyor drops, but churning increases.

Instead of conveying the oil sand to the screw conveyor countercurrent washer 30 via a pump (not shown) in line 22, the screw conveyor can be fed directly by the separator 20 by locating the first end 31 below the separator 20. In either ease, the screw conveyor should be of sufficient length such that the second end 33 rises above the liquid level in the separator 20. This allows for adequate drainage of solvent downwardly in the conveyor and minimizes the amount of solvent exiting the conveyor with the washed sand.

Instead of a screw conveyor, it is possible to wash the oil sand in a filtering apparatus, such as a Lurgi type countercurrent conveyor filter. In such filtering apparatus, solvent is sucked through the sand and repumped, in stages, countercurrently to the conveyed sand.

Whether a screw conveyor or a Lurgi type filter arrangement is used as the countercurrent washer 30, it should be understood that a sufficient amount of solvent is introduced into the countercurrent washer 30 via line 32 to thoroughly remove the occluded oil from the sand. As stated above, any additional solvent needed for bitumen removal can be added directly to the digester via line 17.

Stripping Solvent from Washed Sand

The washed water wet sand (substantially free of occluded oil) still contains solvent which must be stripped from the sand. The washed sand is conveyed from the countercurrent washer 30 to the top 35 of a multi-hearth solvent recovery furnace 36 via line 34. In the preferred embodiment, as shown in FIG. 2, the multi-hearth furnace 36 has an alternating arrangement of centrally located hearths 50, 52, and 54 and peripherally located hearths 56 and 58. Each hearth of the multi-hearth furnace is equipped with rabble arms or rakes (not shown) propelled by a central shaft (not shown) to move the sand horizontally along a hearth either towards the center, if the hearth is a peripheral hearth such as 56 and 58, or towards the perimeter, if the hearth is a centrally located hearth such as 50, 52 and 54. According to the present invention, the multi-hearth furnace should have a sufficient number of hearths heated with oil fired muffles, high pressure steam coils or any other suitable heating device to heat the sand in contact therewith to any desired temperature above the boiling point of the solvent. Preferably, the hearths at the top of the furnace are heated.

Referring to FIG. 2, the washed sand in contact with hearths 50 and 56 is heated to a temperature above the boiling point of the solvent. This hot sand is moved downwardly along the remaining hearths 52, 58 and 54. Recirculated inert gas, such as nitrogen or carbon dioxide) is introduced via line 42 near the bottom 44 of the multi-hearth solvent recovery furnace 36 at a point above the bottom hearth 54. Make-up inert gas, inert gas required to make up for inert gas losses in the closed system of the present invention, is introduced below hearth 54 via line 40. The inert gas, introduced via lines 40 and 42, flowing upwardly flowing against downwardly flowing sand, recovers heat from the downwardly flowing sand and strips out any remaining solvent vapor. Also, the make-up inert gas serves as a replacement for the solvent vapor formerly present in any interstices of sand particles. Substantially clean, solvent free sand is discharged from the solvent recovery furnace 36 at its bottom 44.

The inert gas introduced via lines 40 and 42 serves several functions. First, the inert gas helps to carry the solvent vapors out of the furnace 36. Second, the inert gas helps to prevent the formation of explosive mixtures in the furnace 36 by keeping air out of the furnace 36. Finally, contact of the inert gas with the sand helps recover heat from the sand that would otherwise be lost with the solvent free sand when it is discharged through bottom 44.

The solvent recovery furnace 36 provides several advantages over the prior art methods for solvent recovery from the sand. First, the solvent furnace 36 can reach any temperature necessary to strip substantially 100 percent of the solvent from the sand even when the temperature required to strip the solvent substantially exceeds the boiling point of the solvent due to the vapor pressure suppression phenomenon. In contrast to the present invention, the prior art processes are typically limited to low boiling point solvents, such as pentane, for bitumen extraction because such prior art processes encounter significant difficulties in obtaining temperatures sufficiently high enough to deal with vapor pressure suppression of solvents in contact with tar sands. For example, according to U.S. Pat. No. 4,347,118, the temperature required to recover substantially all of the pentane solvent used therein can exceed the boiling point of pentane by more than 65° C. Second, the solvent recovery furnace 36 permits the use of minimal amounts of inert gas as compared to prior art processes which use large amounts of inert gas to keep the sand suspended in the fluidized bed. Third, unlike the prior art processes, such as those using a fluidized bed, the solvent recovery furnace 36 can handle any amount of moisture in the wet sand. Prior art U.S. Pat. No. 4,347,118 discloses that sand entering the fluidized bed for solvent recovery cannot have more than approximately 2 percent moisture content. Finally, unlike the fluidized beds of the prior art, the solvent recovery furnace 36 has no difficulty with sand particle size variations. Thus, according to the present invention, complete solvent stripping can be efficiently performed in a single apparatus, such as the solvent recovery furnace 36.

Solvent and Heat Recovery

The heat exchanger/scrubber 28 provides an apparatus and mechanism for recovering the solvent vapor stripped from the sand in the solvent recovery furnace 36 as well as some of the heat associated therewith. The hot inert gas carries the water and solvent vapors stripped from the washed sand from the solvent recovery furnace 36 to the bottom of the heat exchanger/scrubber 28 via line 46. As previously described above, product oil is introduce to the top of the heat exchanger/scrubber 28. The heat and solvent recovery performed in the heat exchanger/scrubber 28 is accomplished by allowing the direct contact of downwardly flowing product oil with upwardly flowing solvent vapor, water vapor and inert gas. The cooler product oil in the heat exchanger/scrubber 28 absorbs the solvent and condenses the water vapor. The net result of the contact of the solvent and water vapor with the product oil in the heat exchanger/scrubber is that the product oil in the heat exchanger/scrubber 28 is heated by the heat of vaporization given up by the absorbed solvent and condensed water vapor, and is, accordingly, diluted with the absorbed solvent to form the hot thinning oil fed to the digester 16 via line 14, as previously discussed above. Those skilled in the art should note that the product oil may also extract some heat from the inert gas. If more heat is required to heat the thinning oil in the heat exchanger/scrubber 28 to an optimum temperature for the dissolving bitumen in the digester 16, the solvent recovery furnace 36 temperature can be increased. Also, if more heat is generated in the solvent recovery furnace 36 than is required to raise the thinning oil in the heat/exchanger scrubber to an optimum temperature for dissolving bitumen, the excess heat can be used to remove solvent from the product oil.

Because the product oil introduced to the heat exchanger/scrubber 28 may contain some fines, the heat exchanger/scrubber 28 is provided with a suitable packing material, such as vertical slats, to provide sufficient absorption/condensation surface area that will not clog with the fines. The condensed water in the heat exchanger/scrubber 28 may be withdrawn, as necessary, via line 48 as the water is not further used in the process. The inert gas, cooled by contact with the product oil and removed of much of its contained solvent vapor, is returned to the solvent recovery furnace, via line 42, for reuse. A pressure stabilizer 60 may be attached to line 42 to maintain a positive inert gas pressure in the system 10.

Thus, there has been provided an efficient process for extracting bitumen products from tar sand utilizing recycled solvent and energy. The embodiments disclosed herein admirably achieve the objects of the present invention; however, it should be appreciated by those skilled in the art that departures can be made by those skilled in the art without departing from the spirit and scope of the invention which is limited only by the following claims.

What is claimed is:

1. A process for recovering bitumen products from tar sand, the process comprising the step of:

(a) contacting a viscous tar sand feed comprising sand, oil, resins, asphaltenes, clay and water with heated thinning oil, the thinning oil comprising product oil diluted with solvent vapor, to dissolve at least a portion of the oil, resins and asphaltenes of the tar sand feed in solvent, said contacting step forming a feed slurry having a lower viscosity than the viscosity of the tar sand feed;

(b) mixing the feed slurry with light oil, the light oil comprising solvent and recovered occluded oil, and separating the mixture of feed slurry and light oil into product oil and oil sand, the oil sand comprising sand having occluded oil thereon;

(c) introducing a portion of the product oil to a heat exchanger/scrubber;

(d) washing the oil sand with solvent in a countercurrent fashion so as to recover occluded oil from the oil sand, wherein the washing step forms the light oil mixed with the feed slurry in step (b) and washed sand, the washed sand comprising sand wet with solvent and water having substantially no occluded oil;

(e) heating the washed sand to a temperature above the boiling point of the solvent so as to vaporize substantially all of the solvent from the sand;

(f) flowing inert gas through the heated washed sand to strip the solvent vapor formed in step (e) from the sand and to cool the sand by heat transfer to the inert gas;

(g) directing the inert gas and solvent vapor to the heat exchanger/scrubber wherein the solvent vapor is contacted with the product oil introduced to the heat exchanger/scrubber in step (c), wherein the solvent vapor is absorbed by the product oil to form the heated thinning oil mixed with the tar sand feed in step (a) and wherein the inert gas transfers heat to the thinning oil; and (h) reusing the inert gas to strip the solvent vapor from the sand in step (f).

2. The process of claim 1, wherein the tar sand feed and thinning oil are agitated in step (a).

3. The process of claim 1, wherein step (d) further comprises introducing the oil sand adjacent to a lower end of a sloping screw conveyor and introducing the solvent adjacent to an upper end of the sloping screw conveyor, simultaneously moving the oil sand from the lower end to the upper end of the sloping screw conveyor and moving the solvent from the upper end to the lower end of the screw conveyor.

4. The process of claim 1, wherein the sand is heated in step (e) by introducing the sand to a top of a solvent recovery furnace having a plurality of hearths, at least one of the plurality of hearths being heated, moving the sand along the plurality of hearths from the top of the furnace to a bottom of the furnace where the sand, substantially free of solvent, is discharged.

5. A process for recovering bitumen products from tar sand, the process comprising the steps of:

(a) contacting a viscous tar sand feed comprising sand, oil, resins, asphaltenes, clay and water with heated thinning oil, the thinning oil comprising product oil diluted with solvent, to dissolve at least a portion of the oil, resins and asphaltenes of the tar sand feed in solvent, said contacting step forming a feed slurry having a lower viscosity than the viscosity of the tar sand feed;

(b) mixing the feed slurry with light oil, the light oil comprising solvent and recovered occluded oil, and separating the mixture of feed slurry and light oil into product oil and oil sand, the oil sand comprising sand having occluded oil thereon;

(c) introducing a portion of the product oil to a heat exchanger/scrubber;

(d) washing the oil sand by introducing the oil sand adjacent to a lower end of a sloping screw conveyor and introducing solvent adjacent to an upper end of the sloping screw conveyor, simultaneously moving the oil sand from the lower end to the upper end of the sloping screw conveyor and moving the solvent from the upper end to the lower end of the screw conveyor, wherein the occluded oil in the oil sand is extracted with the solvent in a countercurrent fashion so as to recover occluded oil from the oil sand, wherein the washing of the oil sand forms the light oil mixed with the feed slurry in step (b) and washed sand, the washed sand comprising sand wet with solvent and water;

(e) heating the washed sand to a temperature above the boiling point of the solvent so as to vaporize substantially all of the solvent from the sand by introducing the sand to a top of a solvent recovery furnace having a plurality of hearths, at least one of the plurality of hearths being heated, introducing make-up inert gas at a point adjacent to a bottom of the solvent recovery furnace, introducing recycled inert gas at a point between the top of the solvent recovery furnace and the make-up inert gas, moving the sand along the plurality of hearths from the top of the furnace to the bottom, and flowing inert gas upwardly from the point adjacent to the bottom of the furnace to the top so as to cause the sand moving downwardly to transfer heat and solvent vapors to the inert gas flowing upwardly;

(f) directing solvent vapor formed in step (e) and inert gas to the heat exchanger/scrubber wherein the solvent vapor and inert gas is contacted with the product oil introduced to the heat exchanger/scrubber in step (c), wherein the solvent vapor is absorbed by the product oil to form the heated thinning oil mixed with the tar sand feed in step (a), and wherein the heat contained by the inert gas is transferred to the thinning oil; and (g) directing inert gas cooled in step (f) from the heat/exchanger scrubber to the bottom of the solvent recovery furnace wherein it is introduced as the recycled inert gas in step (e).

6. An apparatus for recovering bitumen products from tar sand, the apparatus comprising:

(a) means for contacting a viscous tar sand feed comprising sand, oil, resins, asphaltenes, clay and water with heated thinning oil, the thinning oil comprising product oil diluted with solvent, to dissolve at least a portion of the oil, resins and asphaltenes of the tar sand feed in solvent to form a feed slurry having a lower viscosity than the viscosity of the tar sand feed;

(b) means for mixing the feed slurry with light oil, the light oil comprising solvent and recovered occluded oil, including means for separating the mixture of feed slurry and light oil into product oil and oil sand, the oil sand comprising sand having occluded oil thereon;

(c) a heat exchanger/scrubber for contacting product oil with solvent vapor;

(d) means for introducing a portion of the product oil to the heat exchanger/scrubber;

(e) means for washing the oil sand with solvent in a countercurrent fashion so as to recover occluded oil from the oil sand to form the light oil mixed with the feed slurry in the separating means and to form washed sand comprising sand wet with solvent and water having substantially no removable occluded oil;

(f) means for heating the washed sand to a temperature above the boiling point of the solvent so as to vaporize substantially all of the solvent from the sand;

(f) means for directing solvent vapor to the heat exchanger/scrubber;

(g) means in the heat exchanger/scrubber for permitting direct contact of the solvent vapor with the product oil so as to cause the solvent vapor to condense and the product oil to absorb the condensed solvent to form the thinning oil;

(h) means for directing the thinning oil to the means for contacting the tar sand feed with the thinning oil.

7. The apparatus of claim 6, wherein the means for washing the oil sand is a sloping screw conveyor.

8. The apparatus of claim 6, wherein the means for heating the washed sand is a solvent recovery furnace having a plurality of peripheral and central hearths, at least one of the hearths being heated.

* * * * *